US007910275B2

(12) United States Patent
Patel et al.

(10) Patent No.: US 7,910,275 B2
(45) Date of Patent: Mar. 22, 2011

(54) TONER HAVING CRYSTALLINE WAX

(75) Inventors: Raj D. Patel, Oakville (CA); David J. Sanders, Oakville (CA); Christine Anderson, Hamilton (CA); Allan K. Chen, Oakville (CA); Daryl W. Vanbesien, Burlington (CA); Patricia A. Burns, Milton (CA)

(73) Assignee: Xerox Corporation, Stamford, CT (US)

( * ) Notice: Subject to any disclaimer, the term of this patent is extended or adjusted under 35 U.S.C. 154(b) by 1171 days.

(21) Appl. No.: 11/274,459

(22) Filed: Nov. 14, 2005

(65) Prior Publication Data

US 2007/0111128 A1 May 17, 2007

(51) Int. Cl.
*G03G 9/087* (2006.01)

(52) U.S. Cl. ..... 430/108.8; 430/109.3; 430/110.3; 430/137.14

(58) Field of Classification Search ..... 430/109.3, 430/108.8, 110.3, 108.4, 137.14
See application file for complete search history.

(56) References Cited

U.S. PATENT DOCUMENTS

| | | | | |
|---|---|---|---|---|
| 4,418,108 | A | | 11/1983 | Lin |
| 5,278,020 | A | | 1/1994 | Grushkin et al. |
| 5,290,654 | A | | 3/1994 | Sacripante et al. |
| 5,308,734 | A | | 5/1994 | Sacripante et al. |
| 5,344,738 | A | | 9/1994 | Kmiecik-Lawrynowicz et al. |
| 5,346,797 | A | | 9/1994 | Kmiecik-Lawrynowicz et al. |
| 5,348,832 | A | | 9/1994 | Sacripante et al. |
| 5,364,729 | A | | 11/1994 | Kmiecik-Lawrynowicz et al. |
| 5,366,841 | A | | 11/1994 | Patel et al. |
| 5,370,963 | A | | 12/1994 | Patel et al. |
| 5,403,693 | A | | 4/1995 | Patel et al. |
| 5,405,728 | A | | 4/1995 | Hopper et al. |
| 5,482,812 | A | | 1/1996 | Hopper et al. |
| 5,496,676 | A | | 3/1996 | Croucher et al. |
| 5,501,935 | A | | 3/1996 | Patel et al. |
| 5,527,658 | A | | 6/1996 | Hopper et al. |
| 5,585,215 | A | | 12/1996 | Ong et al. |
| 5,622,806 | A | | 4/1997 | Veregin et al. |
| 5,650,255 | A | | 7/1997 | Ng et al. |
| 5,650,256 | A | | 7/1997 | Veregin et al. |
| 5,695,899 | A | * | 12/1997 | Kamada et al. ..... 430/110.4 |
| 5,723,253 | A | | 3/1998 | Higashino et al. |
| 5,744,520 | A | | 4/1998 | Kmiecik-Lawrynowicz et al. |
| 5,747,215 | A | | 5/1998 | Ong et al. |
| 5,763,133 | A | | 6/1998 | Ong et al. |
| 5,766,818 | A | | 6/1998 | Smith et al. |
| 5,776,649 | A | * | 7/1998 | Sorriero et al. ..... 430/125.6 |
| 5,804,349 | A | | 9/1998 | Ong et al. |
| 5,827,633 | A | | 10/1998 | Ong et al. |
| 5,840,462 | A | | 11/1998 | Foucher et al. |
| 5,853,944 | A | | 12/1998 | Foucher et al. |
| 5,863,698 | A | | 1/1999 | Patel et al. |
| 5,869,215 | A | | 2/1999 | Ong et al. |
| 5,902,710 | A | | 5/1999 | Ong et al. |
| 5,910,387 | A | | 6/1999 | Mychajlowskij et al. |
| 5,914,210 | A | * | 6/1999 | Demizu et al. ..... 430/106.2 |
| 5,916,725 | A | | 6/1999 | Patel et al. |
| 5,919,595 | A | | 7/1999 | Mychajlowskij et al. |
| 5,922,501 | A | | 7/1999 | Cheng et al. |
| 5,925,488 | A | | 7/1999 | Patel et al. |
| 5,977,210 | A | | 11/1999 | Patel et al. |
| 5,994,020 | A | | 11/1999 | Patel et al. |
| 6,020,101 | A | | 2/2000 | Sacripante et al. |
| 6,120,967 | A | | 9/2000 | Hopper et al. |
| 6,130,021 | A | | 10/2000 | Patel et al. |
| 6,628,102 | B2 | | 9/2003 | Batson |
| 7,291,434 | B2 | * | 11/2007 | Ishiyama et al. ..... 430/108.8 |
| 7,413,842 | B2 | * | 8/2008 | Vanbesien et al. ..... 430/137.14 |
| 7,588,874 | B2 | * | 9/2009 | Tomita et al. ..... 430/110.3 |
| 2004/0130054 | A1 | | 7/2004 | Riffer |
| 2005/0048389 | A1 | | 3/2005 | Cheng et al. |
| 2005/0181294 | A1 | * | 8/2005 | Hopper et al. ..... 430/105 |
| 2006/0167122 | A1 | * | 7/2006 | Haraguchi et al. ..... 521/60 |

FOREIGN PATENT DOCUMENTS

| | | | |
|---|---|---|---|
| EP | 1 132 777 | A | 9/2001 |
| EP | 1 441 260 | A | 7/2004 |
| JP | 06-123994 | | 5/1994 |
| JP | 07-036218 | | 2/1995 |
| JP | 10-026842 | | 1/1998 |
| JP | 11-338189 | | 12/1999 |
| JP | 2002-116576 | | 4/2002 |
| JP | 2005-182063 | | 7/2005 |
| JP | 2005-182064 | | 7/2005 |
| JP | 2005-266598 | | 9/2005 |
| JP | 2007-140519 | | 6/2007 |
| WO | WO 01/27698 | A | 4/2001 |

OTHER PUBLICATIONS

Patent Abstracts of Japan English-language abstract describing Japanese published application JP 06-056503 A (pub. Mar. 1994).*
USPTO English-language translation of Japanese published application JP 06-056503 A (pub. Mar. 1994).*

* cited by examiner

*Primary Examiner* — Janis L Dote
(74) *Attorney, Agent, or Firm* — Carter, DeLuca, Farrell & Schmidt, LLP

(57) ABSTRACT

Embodiments include a chemical toner composition having a first resin including a styrene vinyl copolymer and having a Tg of from about 46 to about 56° C., b) a second resin including a styrene vinyl copolymer having a Tg of from about 55 to about 65° C., c) a distilled wax having a heat of crystallization and a heat of enthalpy, both from about 1.0 to about 4.0 J/g for every weight percent of the wax used in the chemical toner composition, and wherein the wax has a peak melting point of from about 70 to about 99° C., and d) a colorant, wherein the chemical toner has a gloss of from about 30 to about 80 GGU.

24 Claims, 5 Drawing Sheets

FIG. 2
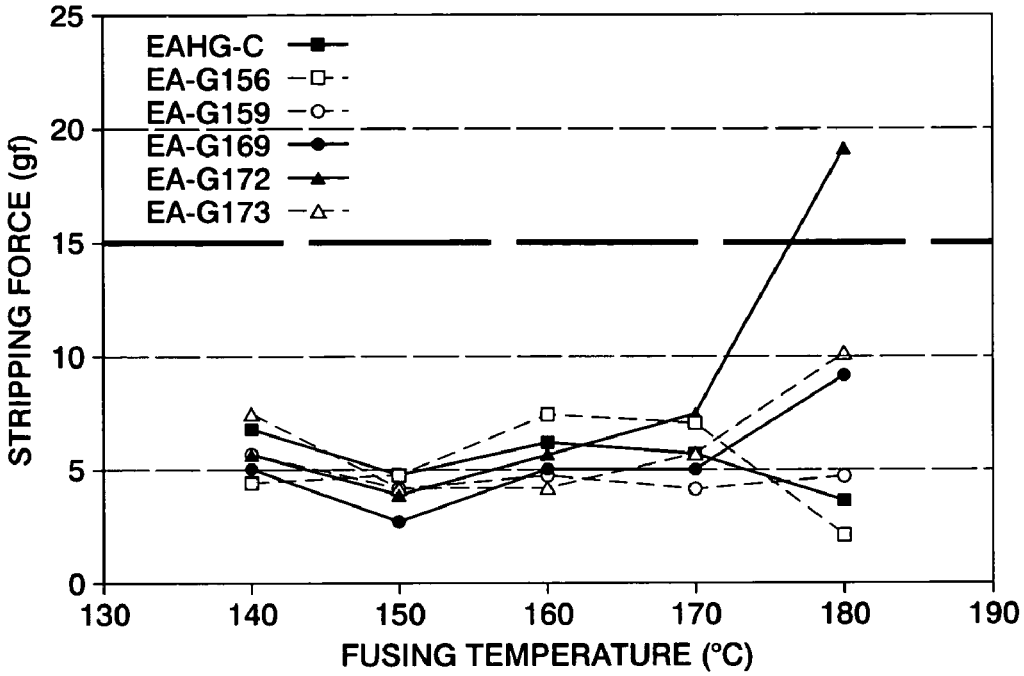
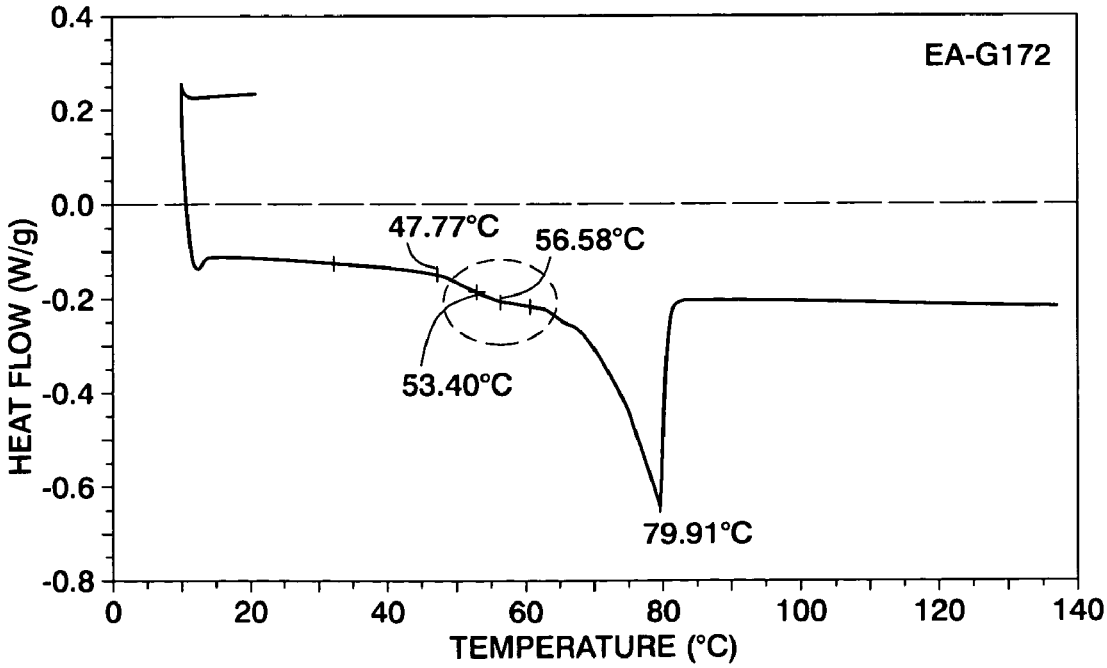
FIG. 3

FIG. 4
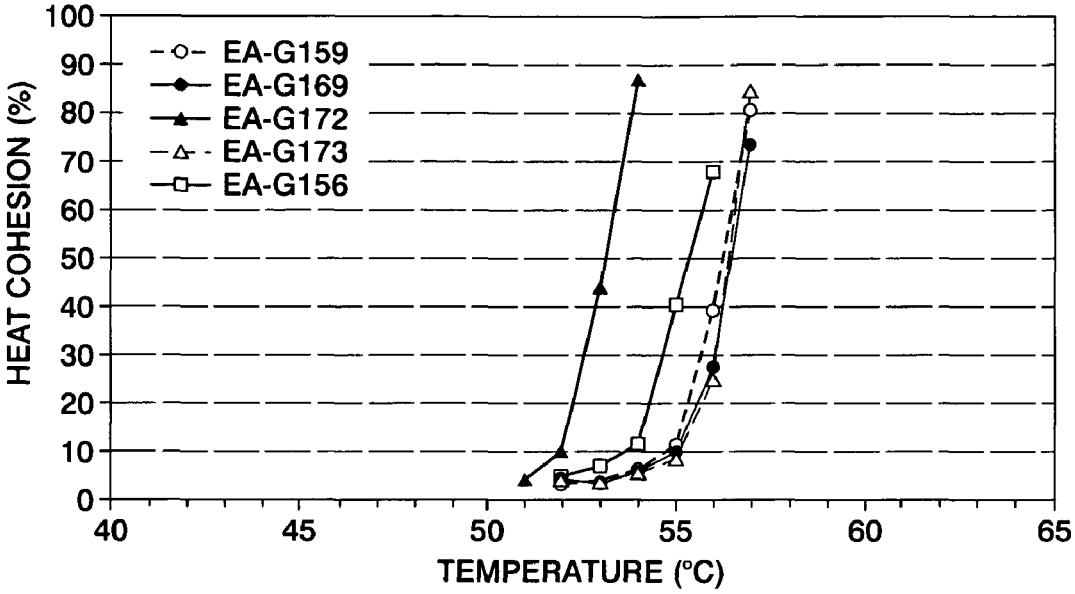
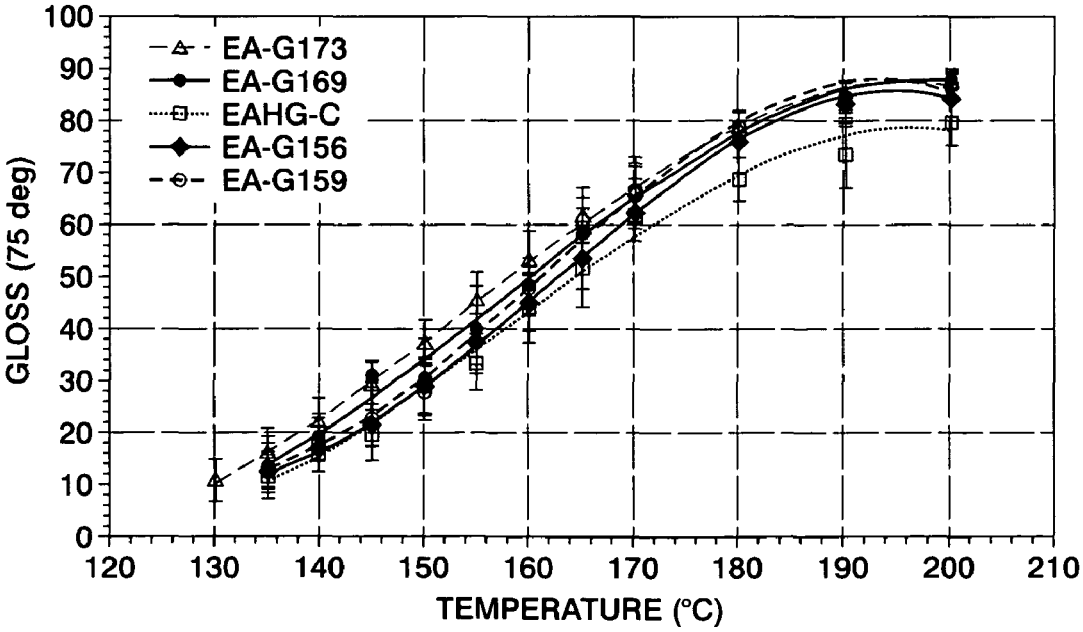
FIG. 5

FIG. 6
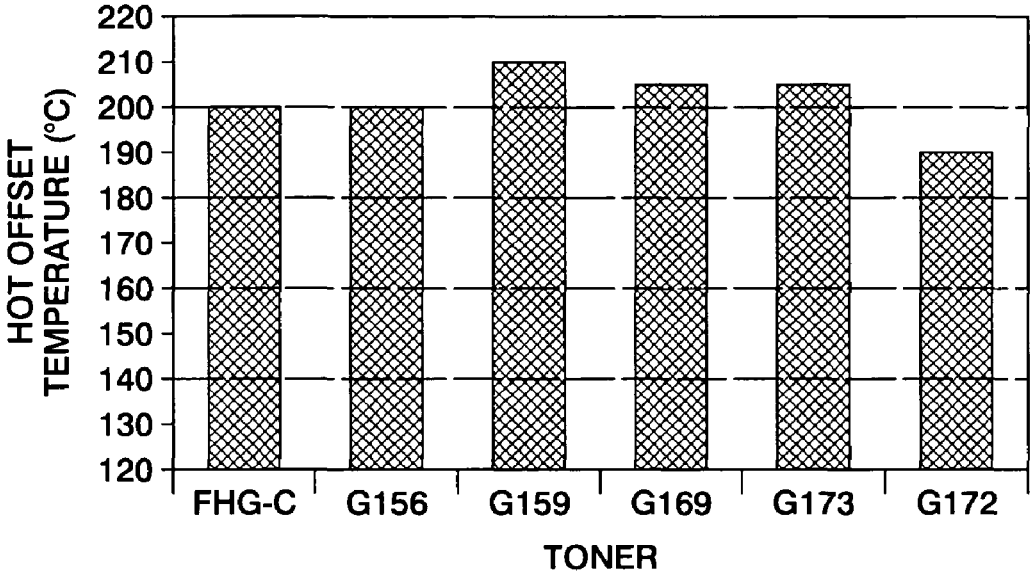
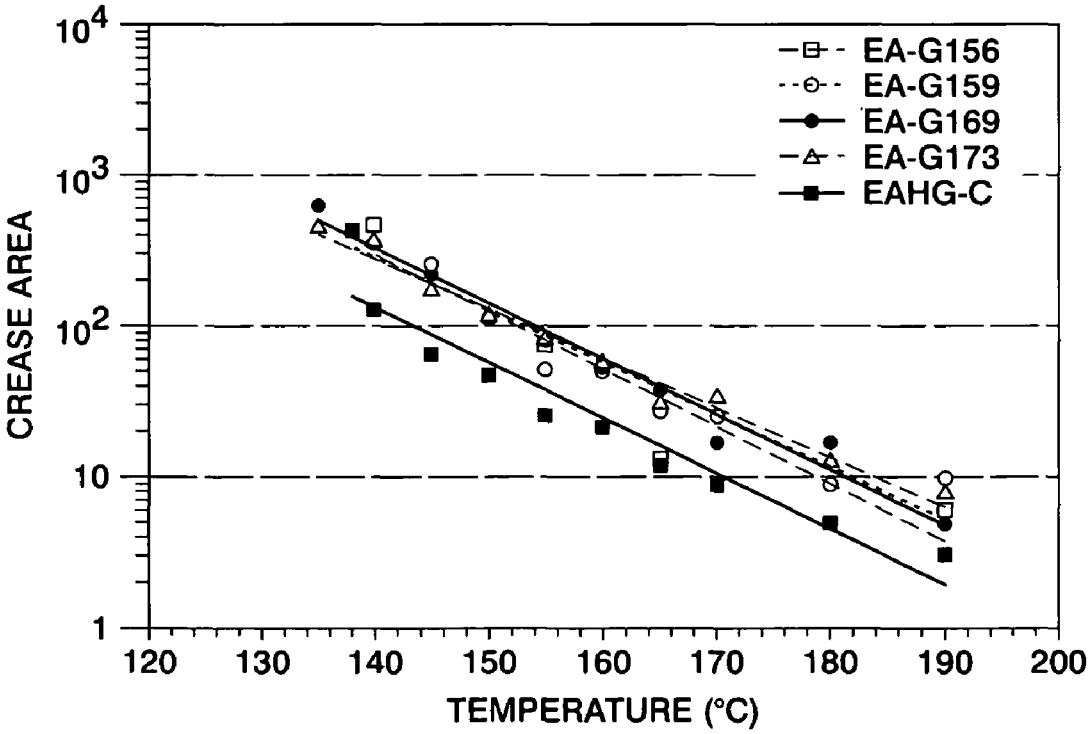
FIG. 7

TONER HAVING CRYSTALLINE WAX

CROSS-REFERENCE TO RELATED APPLICATIONS

Attention is directed to commonly-assigned, currently pending U.S. patent application Ser. No. 11/273,798, filed Nov. 14, 2005, entitled "Crystalline Wax;" U.S. patent application Ser. No. 11/273,895, filed Nov. 14, 2005, entitled, "Crystalline Wax;" U.S. patent application Ser. No. 11/273,748, filed Nov. 14, 2005, "Toner having Crystalline Wax;" U.S. patent application Ser. No. 11/273,751, filed Nov. 14, 2005, entitled, "Toner having Crystalline Wax;" and U.S. patent application Ser. No. 11/126,745, filed May 11, 2005, entitled, "Method of Purification of Polyalkylene Material." The disclosures of these patent applications are hereby incorporated by reference in their entirety.

BACKGROUND

The present disclosure is generally related to toners and toner compositions. The toners comprise distilled or fractionated waxes referred to herein as wax or waxes. The waxes herein can be crystalline waxes. The toners can be prepared by emulsion aggregation (EA) and coalescence processes. The resulting toners have improved gloss characteristics. The resulting toners can be selected for known electrophotographic, electrostatographic, xerographic, and like imaging processes, including copying, printing, faxing, scanning, and like machines, and including digital, image-on-image, color, lithography, and like processes.

In reprographic technologies, such as xerographic and ionographic devices, it is desired to provide toners with high gloss. It is also desired to provide toners that can be used in an oil-less environment, and at low minimum fusing temperatures. It is further desired to provide toners that can be used in high-speed printing and/or copying and the like, machines.

Toners in accordance with embodiments herein, provide desired fusing characteristics including, for example, release characteristics such as a stripping force of less than about 30 to less than about 5 grams of force; blocking characteristics such as a high blocking temperature of about 45° C. to about 65° C.; document offset characteristics such as a document offset of about 2.0 to about 5.0; vinyl offset characteristics such as a vinyl offset of about 3.0 to about 5.0; and triboelectrical charging characteristics. Further, toners in embodiments herein, enable the use of lower minimum imaging fusing temperatures, such as from about 120° C. to about 170° C., enable high speed printing such as for machines running at greater than about 35 pages per minute. Further, the present toners, in embodiments, enable high image gloss, such as in an oil-less fuser system, while still retaining a high blocking temperature, high image gloss comprising of for example from about 30 to about 80 gloss units (GGU), as measured by the Gardner Gloss metering unit; for example on a coated paper, such as Xerox 120 gsm Digital Coated Gloss papers.

Illustrated in U.S. Pat. No. 5,994,020, the disclosure of which is totally incorporated herein by reference, are toner preparation processes, and more specifically, a process for the preparation of toner comprising: (i) preparing, or providing a colorant dispersion; (ii) preparing, or providing a functionalized wax dispersion comprised of a functionalized wax contained in a dispersant mixture comprised of a nonionic surfactant, an ionic surfactant, or mixtures thereof; (iii) shearing the resulting mixture of the functionalized wax dispersion (ii) and the colorant dispersion (i) with a latex or emulsion blend comprised of resin contained in a mixture of an anionic surfactant and a nonionic surfactant; (iv) heating the resulting sheared blend of (iii) below about the glass transition temperature (Tg) of the resin particles; (v) optionally adding additional anionic surfactant to the resulting aggregated suspension of (iv) to prevent, or minimize additional particle growth of the resulting electrostatically bound toner size aggregates during coalescence (iv); heating the resulting mixture of (v) above about the Tg of the resin; and optionally, (vii) separating the toner particles.

Emulsion/aggregation/coalescence processes for the preparation of toners are illustrated in a number of Xerox patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; 5,977,210; 5,994,020; 6,020,101; 6,130,021; 6,120,967 and 6,628,102.

In addition, the following U.S. patents relate to emulsion aggregation processes of forming toner compositions, the disclosures of each of which are totally incorporated herein by reference.

U.S. Pat. No. 5,922,501 describes a process for the preparation of toner comprising blending an aqueous colorant dispersion and a latex resin emulsion, and which latex resin is generated from a dimeric acrylic acid, an oligomer acrylic acid, or mixtures thereof and a monomer; heating the resulting mixture at a temperature about equal, or below about the glass transition temperature (Tg) of the latex resin to form aggregates; heating the resulting aggregates at a temperature about equal to, or above about the Tg of the latex resin to effect coalescence and fusing of the aggregates; and optionally isolating the toner product, washing, and drying.

U.S. Pat. No. 5,482,812 describes a process for the preparation of toner compositions or toner particles comprising (i) providing an aqueous pigment dispersion comprised of a pigment, an ionic surfactant, and optionally a charge control agent; (ii) providing a wax dispersion comprised of wax, a dispersant comprised of nonionic surfactant, ionic surfactant or mixtures thereof; (iii) shearing a mixture of the wax dispersion and the pigment dispersion with a latex or emulsion blend comprised of resin, a counterionic surfactant with a charge polarity of opposite sign to that of said ionic surfactant, and a nonionic surfactant; (iv) heating the above sheared blend below about the glass transition temperature (Tg) of the resin to form electrostatically bound toner size aggregates with a narrow particle size distribution; (v) adding additional ionic surfactant to the aggregated suspension of (iv) to ensure that no, or minimal additional particle growth of the electrostatically bound toner size aggregates occurs on further increasing the temperature to coalesce the aggregates into toner particles (vi); (vi) heating the mixture of (v) with bound aggregates above about or at the Tg of the resin; and optionally (vii) separating the toner particles from the aqueous slurry by filtration and thereafter optionally washing.

U.S. Pat. No. 5,622,806 describes a process, for example, for the preparation of toner compositions with controlled particle size comprising (i) preparing a pigment dispersion in water, which dispersion is comprised of a pigment, an ionic surfactant in amounts of from about 0.5 to about 10 percent by weight to water, and an optional charge control agent; (ii)

shearing the pigment dispersion with a latex mixture comprised of a counterionic surfactant with a charge polarity of opposite sign to that of the ionic surfactant, a nonionic surfactant, and resin particles, thereby causing a flocculation or heterocoagulation of the formed particles of pigment, resin, and charge control agent; and (iii) stirring.

U.S. Patent Application Publication 2004/0130054 A1 discloses waxes used in inks and toners. The waxes have a melting point of 50 to 120° C. and 55 to 100° C., and a melting range of 5 to about 65° C.

It is desired to provide a toner which has a high gloss, and which has desired release or stripping. It is further desired to provide a toner requiring a minimum fixing temperature, wherein the toner has a wide fusing latitude, high blocking temperature, robust particles, tribo electrical properties, and/or the like, which are requirements for toners to be used in high speed machines producing 35 pages per minute and above.

BRIEF DESCRIPTION OF THE DRAWINGS

Reference may be had to the accompanying drawings, which include:

FIG. 2 is a graph of stripping force versus fusing temperature for toners in accordance with an embodiment disclosed herein.

FIG. 3 is a graph of heat flow versus temperature for a toner in accordance with an embodiment disclosed herein.

FIG. 4 is a graph of heat cohesion versus temperature for toners in accordance with an embodiment disclosed herein.

FIG. 5 is a graph of gloss versus temperature for a toner in accordance with an embodiment disclosed herein.

FIG. 6 is a bar graph of temperature versus type of toner, showing gloss defect of various toners.

FIG. 7 is a graph showing crease area versus temperature of toners in accordance with an embodiment disclosed herein.

SUMMARY

Figure 1:
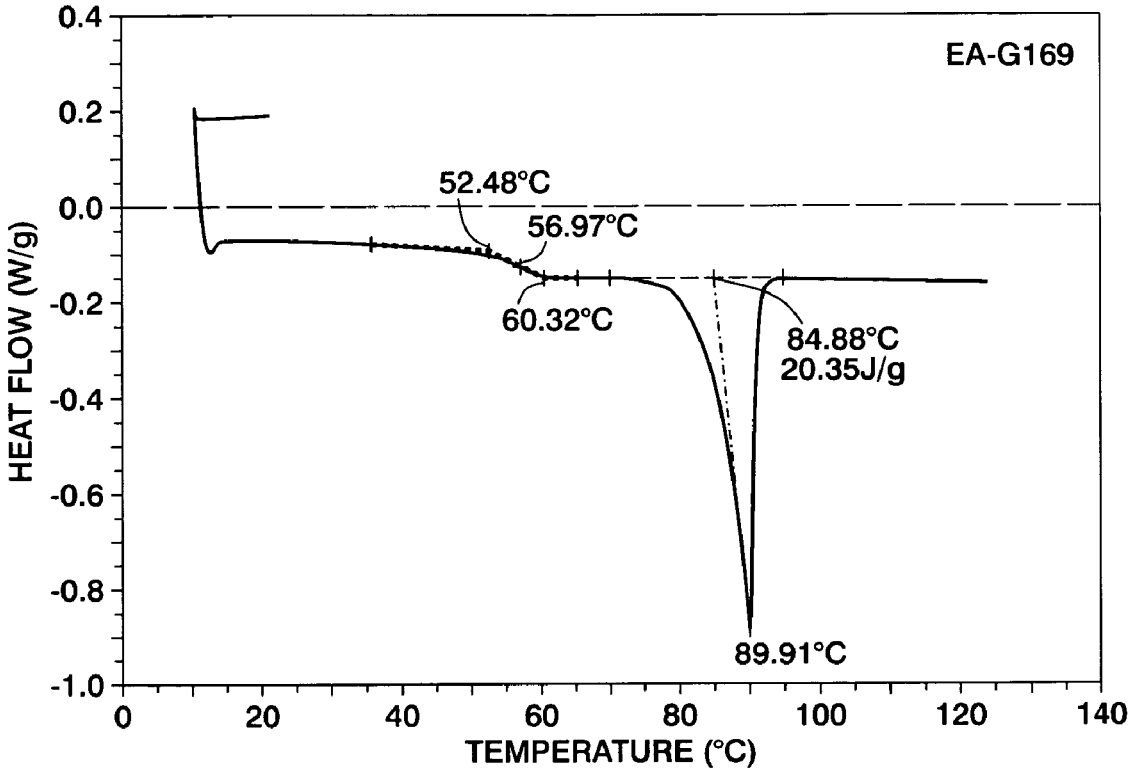
FIG. 1 is a DSC curve of heat flow versus temperature for a toner in accordance with an embodiment disclosed herein.

Embodiments include a chemical toner composition comprising a) a first resin comprising a styrene vinyl copolymer and having a Tg of from about 46 to about 56° C., b) a second resin comprising a styrene vinyl copolymer having a Tg of from about 54 to about 65° C., c) a distilled wax having a heat of crystallization and a heat of enthalpy, both from about 1.0 to about 4.0 J/g for every weight percent of the wax used in the chemical toner composition, and wherein the wax has a peak melting point of from about 70 to about 99° C., and d) a colorant, wherein the chemical toner has a gloss of from about 30 to about 80 GGU.

Embodiments also include a chemical toner composition comprising a) a first resin comprising a styrene vinyl copolymer and having a Tg of from about 48 to about 54° C., and a Mw of from about 30,000 to about 37,000, b) a second resin comprising a styrene n-butyl acrylate having a Tg of from about 56 to about 64° C., c) a distilled wax having a heat of crystallization and a heat of enthalpy, both from about 1.0 to about 4.0 J/g for every weight percent of the wax used in the chemical toner composition, and wherein the wax has a peak melting point of from about 70 to about 99° C., and d) a colorant, wherein the chemical toner has a gloss of from about 30 to about 80 GGU.

Embodiments further include a chemical toner composition comprising a) a first resin comprising styrene, butyl acrylate and beta carboxy ethyl acrylate, and having a Tg of from about 46 to about 56° C., b) a second resin comprising a styrene vinyl copolymer having a Tg of from about 54 to about 65° C., c) a distilled wax having a heat of crystallization and a heat of enthalpy, both from about 1.0 to about 4.0 J/g for every weight percent of the wax used in the chemical toner composition, and wherein the wax has a peak melting point of from about 70 to about 99° C., and d) a colorant, wherein the chemical toner has a gloss of from about 30 to about 80 GGU.

DETAILED DESCRIPTION

In embodiments, there is disclosed a fractionated or distilled wax, and more specifically, a crystalline wax, and a toner comprising the wax. The wax can be selected from, for example, a polyolefin wax, an alkylene wax, a polyethylene wax, a polypropylene wax, a paraffin wax, a Fischer Tropsch wax, microcrystalline wax, carnauba wax, jojoba wax, rice wax, beeswax, montanic acid ester wax, castor wax, or mixtures thereof. In embodiments, the wax is a polyethylene wax or a Fischer Tropsch wax, and in specific embodiments, fractionated, crystalline, and/or distilled polyethylene wax. The polyethylene wax, in embodiments, is derived from ethylene polymerization.

The wax can be prepared using different catalysts including Ziegler-Natta, Fischer Tropsch, metallocene, and like catalysts. Details of how the wax can be made can be found in U.S. Patent Application Publication No. US 20050130054 A1 and U.S. Pat. No. 5,500,321, the subject matter of which is hereby incorporated by reference in the entirety for both of these references.

Figure 8:
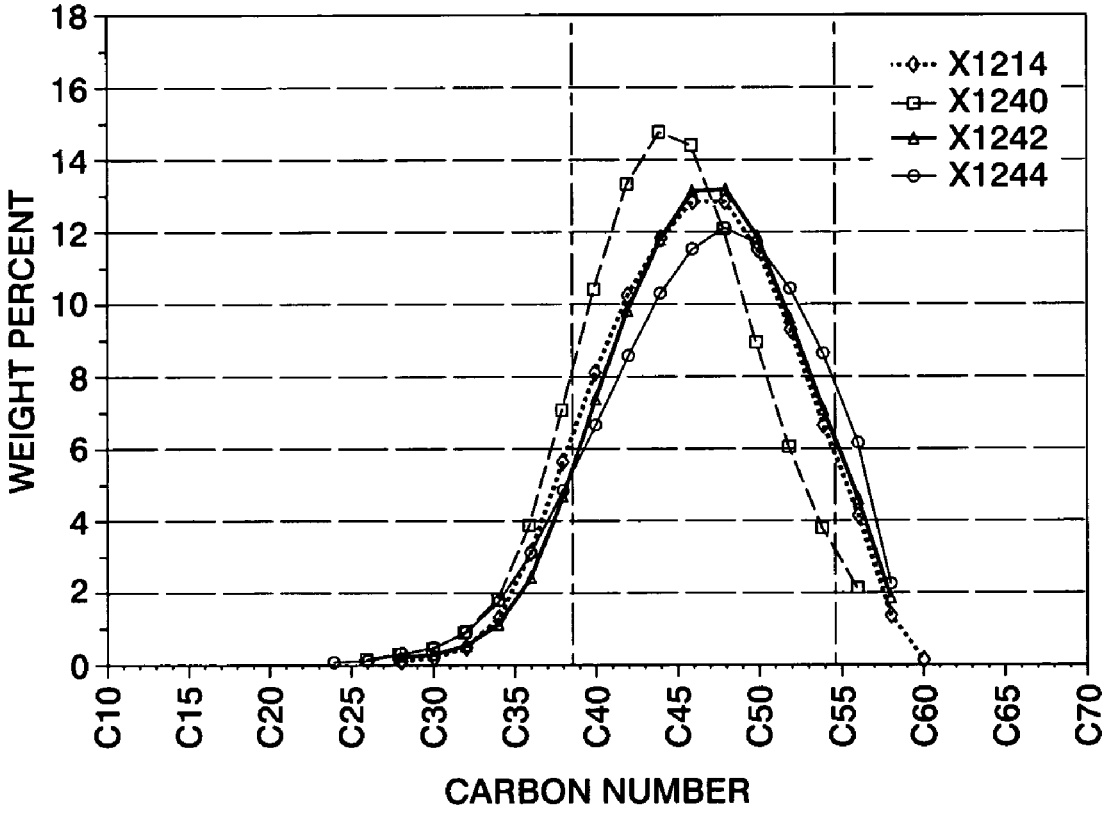
FIG. 8 is a graph of weight percent versus carbon number for a wax in accordance with an embodiment disclosed herein.

In embodiments, the number of carbon units for the wax ranges from about 30 to about 62 carbons, and the peak from about 42 to about 55. At 30 carbon units, the weight percent is at about 0.5 weight percent; while at 60 carbon units, the weight percent is at about 0.5 weight percent. The peak weight percent is less than or equal to 20 percent, or from about 1 to about 15 percent, as measured by a gas chromatograph. FIG. 8 represents a schematic of the distribution as well as peak ranges of the repeating carbon units.

In embodiments, the wax has a degree of crystallinity (Xc) as calculated by heat of melting or heat of fusion or enthalpy, and as measured by DSC, of from about 55 to about 100 percent, or from about 60 to about 98 percent, or from about 70 to about 95 percent, or from about 75 to about 90 percent.

The heat of enthalpy (Hm) generated by the melting of the distilled/fractionated wax contained in a toner is in the range of from about 1.0 to about 4.0, or from about 1.5 to about 3.0 J/g for every weight percent of wax in the toner. For example, if 11 weight percent said wax were to be used, the heat of enthalpy generated would be in the range of from about 11 J/g to about 44 J/g as measured on the second heat where the heating rate is 10° C./min (See FIG. 1).

The heat evolved during recrystallization (Hrc) of the distilled/fractionated wax contained in the toner during the cooling cycle is in the range of from about 1.0 to about 4.0, or from about 1.5 to about 3.0 J/g for every weight percent of wax in the toner. For example if 11 weight percent said wax were to be used, the heat of recrystallization (Hrc) generated would be in the range of 11 J/g to about 44 J/g as measured during the cooling cycle where the cooling rate is 2° C./min.

In embodiments, there is a difference between the crystallinity measured using the heat of enthalpy above, and the crystallinity as measured using the heat of recrystallization above of not more than about 15 percent, or from about 0.01 to about 15 percent; not greater than about 10 percent, or from about 0.01 to about 10 percent; not greater than about 5 percent, or from about 0.01 to about 5 percent; or not greater than about 1 percent, or from about 0.01 to about 1 percent.

During coalescence of the aggregates comprising resin, colorant and wax, the temperature is above the resin Tg. Therefore, the temperature range selected results in a viscosity that allows the wax to flow in the resin matrix, allowing for the wax domains to be formed. The wax domains in the toner particle can be larger (for example, from about 0.5 to about 2 microns) than the starting size (for example, from about 0.15 to about 0.8 microns).

The wax in the toner particle has an onset temperature of from about 65 to about 70° C., and an offset temperature of from about 95 to about 100° C., during the heat up cycle (i.e., melting), as measured by a DSC when the heating rate is 10° C./min.

In embodiments, the wax has a peak melting point of from about 70 to about 99, or from about 80 to about 95° C., or from about 85 to about 94° C. Waxes meeting this requirement when incorporated in the toner in the amount of ≧7 weight percent provide the required release (stripping) of ≦15 gram force over a fusing temperature of 140° C. to about 180° C. Waxes that do not meeting the above criteria shows increased stripping force (EA-G172) (See FIG. 2).

Fractionated waxes contained in the toner that do not meet the peak melting point temperature range requirement can cause problems with toner blocking. For example the wax used in EA-G172 has a peak melt point of 80° C., and when incorporated into a toner composition, shows that the onset point of the wax is embedded into the host resin's glass transition (Tg) melting proprieties (See FIG. 3), thereby depressing the Tg of the toner and hence resulting in a reduced toner blocking temperature which is highly undesirable (See FIG. 4).

For toner to meet blocking requirement another consideration that is desired is that the degree of separation between the offset point of the resin and the onset point of the distilled wax to be ≧2° C., or from about 2 to about 7° C. to avoid depression of the toner Tg (See FIG. 1), which in turn provides good release and blocking (EA-G169). Toners which do not exhibit such separation (See FIG. 3) exhibit poor release and blocking (EA-G172). The toner resin Tg should have an onset Tg of about 52° C. and an offset Tg of about 63° C.

The blocking temperature can be measured by measuring the heat cohesion of the toner as a function of temperature. Heat cohesion is measured as follows: A quantity of toner (MT, typically 5 grams) is manually sifted through a 1,000 micron screen to remove any large agglomerates. The sifted toner is placed in an aluminum boat and conditioned in an environmental oven at temperature T, and 50% RH for 17 hrs. The toner is then removed from the oven and allowed to cool. The heat cohesion is measured by placing the toner into the uppermost screen in a HOSOKAWA™ Vibration apparatus. The uppermost screen (A) is 1,000 micron, while the lower screen (B) is 106 micron. The sample is vibrated at an amplitude of 1 mm for 90 sec. The mass of toner remaining on each screen, $M_A$ and $M_B$ is measured, and the heat cohesion for temperature T is calculated as % cohesion (T)=$[(M_A+M_B)/M_T]\times 100$. Typically, heat cohesion should be measured over a temperature range starting below the onset Tg of the toner, and extending until the heat cohesion is >50%. The blocking temperature is defined as the highest temperature for which the toner heat cohesion is ≦10%. The blocking temperature is from about 45 to about 65° C., or from about 53 to about 65° C.

Examples of waxes include those as illustrated herein, such as those of the aforementioned co-pending applications, polyolefins such as polypropylenes, polyethylenes, and the like, such as those commercially available from Allied Chemical and Baker Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K.K., and similar materials. Examples of functionalized waxes include amines, amides, for example AQUA SUPERSLIP 6550™, SUPERSLIP 6530™ available from Micro Powder Inc.; fluorinated waxes, for example POLYFLUO 190™, POLYFLUO 200™, POLYFLUO 523XF™, AQUA POLYFLUO 411™, AQUA POLYSILK 19™, POLYSILK 14™ available from Micro Powder Inc.; mixed fluorinated, amide waxes, for example MICROSPERSION 19™ also available from Micro Powder Inc.; imides, esters, quaternary amines, carboxylic acids or acrylic polymer emulsion, for example JONCRYL 74™, 89™, 130™, 537™, and 538™, all available from SC Johnson Wax; chlorinated polypropylenes and polyethylenes available from Allied Chemical and Petrolite Corporation, and from SC Johnson Wax. Such waxes can optionally be fractionated or distilled to provide specific cuts that meet viscosity and/or temperature criteria wherein the upper limit of viscosity is 10,000 cps and the temperature upper limit is 100° C.

In embodiments, the wax comprises a wax in the form of a dispersion comprising, for example, a wax having a particle diameter of about 100 nanometers to about 500 nanometers, or about 100 nanometers to about 300 nanometers, water, and an anionic surfactant or a polymeric stabilizer, and optionally a nonionic surfactant. In embodiments, the wax comprises polyethylene wax particles, such as POLYWAX® 655, or POLYWAX® 725, POLYWAX® 850, POLYWAX® 500 (the POLYWAX® waxes being commercially available from Baker Petrolite) and, for example, fractionated/distilled waxes which are cuts of commercial POLYWAX® 655 designated here as X1214, X1240, X1242, X1244, and the like, but are not limited to POLYWAX® 655 cuts. Waxes providing a specific cut, that meet the viscosity/temperature criteria, wherein the upper limit of viscosity is 10,000 cps and the temperature upper limit is 100° C. can be used. The waxes can have a particle diameter in the range of from about 100 to about 500 nanometers, although not limited. Other examples include FT-100 waxes from Shell (SMDA), and FNP0092 from Nippon Seiro. The surfactant used to disperse the wax can be an anionic surfactant, although not limited thereto, such as, for example, NEOGEN RK® commercially available from Daiichi Kogyo Seiyaku or TAYCAPOWER® BN2060 commercially available from Tayca Corporation or DOWFAX™ available from DuPont.

In embodiments, the wax has an onset melt temperature of from about 65 to about 75° C., and an offset temperature of from about 95 to about 100° C.

In embodiments, the wax has an Mn, Mw and Mp, and each and all may fall within the ranges of from about 500 to about 800, or from about 600 to about 750, or from about 640 to about 725. The wax has a polydispersity (Mw/Mn) of from about 1 to about 1.05.

The wax in a toner material is present, for example, in an amount of about 5 to about 30 percent, or from about 7 to about 20 percent by weight based upon the total weight of the composition.

The toners herein, in embodiments, exhibit a high gloss of from about 30 to about 80 gloss units (GGU), or from about 40 to about 70 GGU, as measured by the Gardner Gloss metering unit; for example on a coated paper, such as Xerox 120 gsm Digital Coated Gloss papers, or on plain paper such as Xerox 90gsm Digital Color Xpressions+ paper.

The shape or circularity of the toner particle containing fractionated waxes should be ≧0.95, or from about 0.95 to about 1.00, or from about 0.95 to about 0.99, where 1.00 is considered perfectly spherical as measured on the SYSMEX™ FPIA 2100 instrument. Another way to describe the shape of the toner particle is by Shape factor (SF), where the desired SF is ≦125, or from about 100 to about 130, or from about 110 to about 125, where 100 is defined as a perfect sphere.

The melt properties of a toner can be characterized by its melt flow index (MFI). Melt flow index measures the rate of extrusion of a molten resin through a die of a specified length and diameter under prescribed conditions of temperature, load, and piston position in the barrel as the timed measurement is made. The measurement consists of charging 8.0 grams of dry toner into the reservoir of the melt flow Index device, waiting for a specific equilibrium period, applying a constant weight, and measuring the time (Tp) it takes for a known distance of instrument piston travel. The melt flow Index is the mass of extruded toner (MT) divided by the time of piston travel, (MFI=MT/Tp) expressed in units of grams/10 minutes. Melt flow Index measurements are further described in ASTM Test Method D1238. A suitable device for measuring MFI is the Model MP 987 Extrusion Plastometer produced by the Tinius Olsen Co., Willow Grove, Pa., USA.

The toners containing the fractionated waxes give a MFI value of >25, or from about 25 to about 50 as measured at a temperature of 125° C., and a load of 5 Kg.

A single point surface area uses a single measurement taken at one partial pressure (0.2 or higher) and defines the linear BET plot by assuming that the plot has an intercept of zero. A multipoint surface area uses measurements from several partial pressures to better define the BET plot and its intercept. The Chemical toners prepared by EA process containing distilled or fractionated waxes have a BET (single point or multi point) of ≧1.20 m2/g, or from about 1.2 to about 1.7.

The toners containing the distilled/fractionated wax have a toner cohesion of ≦65 percent as measured by the HOSOKAWA™ test. The toner cohesion is in the range of from about 5 to about 65 percent as measured by the HOSOKAWA™ a test protocol stated. Approximately 2 g (MT) of toner is placed into the uppermost screen in the HOSOKAWA™ vibration apparatus. Three screens are arranged as follows: The uppermost screen (A) is 53 micron, the middle screen (B) is 45 micron, and the lower screen (C) is 38 micron. The HOSOKAWA™ device is set to vibrate at an amplitude of 1 mm for 90 seconds. The mass of toner remaining on each screen is measured as MA, MB, and MC. The contribution from each screen is assigned different weightings, and the cohesion is calculated as percent cohesion (Flow)=[(MA/MT)+⅗(MB/MT)+⅕(MC/MT)]×100, wherein MA is the toner mass collected on a 53 micron pore size screen, MB is the toner mass collected on a 45 micron pore size screen, MC is the toner mass collected on a 38 micron pore size screen, and MT is the mass of the toner quantity used.

Chemical toner is defined as toner made by emulsion aggregation and is prepared by a process including, in embodiments, (i) generating or providing a latex emulsion containing resin, water, and a surfactant, and generating or providing a colorant dispersion containing colorant, water, and an ionic surfactant, or a nonionic surfactant; (ii) blending the latex emulsion with the colorant dispersion and wax; (iii) adding to the resulting blend a coagulant comprising a polymetal ion coagulant, a metal ion coagulant, a polymetal halide coagulant, a metal halide coagulant or a mixture thereof; (iv) aggregating by heating the resulting mixture below or about equal to the glass transition temperature (Tg) of the latex resin; (v) optionally adding a second latex comprised of resin particles suspended in an aqueous phase resulting in a shell; (vi) introducing sodium hydroxide solution to raise the pH of the mixture to about 4.0, followed by the addition of a sequestering agent to partially remove coagulant metal from the aggregated toner in a controlled manner; (vii) heating the resulting mixture of (vi) above about the Tg of the latex resin at a pH of from about 5 to about 6; (viii) retaining the heating until the fusion or coalescence of resin and colorant is initiated; (ix) changing the pH of the above (viii) mixture to arrive at a pH from about 6.0 to about 7.5 to thereby accelerate the fusion or the coalescence and resulting in toner particles comprised of resin, colorant, and having a final coagulant metal concentration of from about 100 to about 900 parts per million based on the total weight of the toner particle; and (x) optionally, isolating the toner.

Emulsion aggregation (EA) high gloss toners are prepared as described above and below. In embodiments, polyaluminum chloride (PAC) is used as a coagulant. Other coagulants can be used herein. This coagulant causes crosslinking and hence reduces the gloss. Chelating/sequestering reagents such as EDTA or sodium silicate are used to remove the metal ion, such as aluminum, in a very controlled manner. The final aluminum content in the toner is in the range of about 250 to about 500 ppm. In embodiments, the final metal ion content in the toner is in the range of about 250 to about 500 ppm. Toners meeting these criteria provide the required gloss (See FIG. 5) and the hot offset (See FIG. 6). The crease of the toners is shown in FIG. 7. In embodiments, the crease (80) minimum fixing temperature (MTF) is from about 140 to about 160° C., or from about 140 to about 155° C.

Toners herein can include resins. The resin particles can be, in embodiments, styrene acrylates, styrene butadienes, styrene methacrylates, or polyesters, present in various effective amounts, such as from about 70 weight percent to about 98 weight percent, and more specifically, about 80 weight percent to about 92 weight percent based upon the total weight percent of the toner. The resin can be of small average particle size, such as from about 0.01 micron to about 1 micron in average volume diameter as measured by the Brookhaven nanosize particle analyzer. Other effective amounts of resin can be selected.

As used herein, a non-crosslinked resin is a resin that is substantially free of crosslinking, for example, a resin having substantially about zero percent cross linking to about 0.2 percent crosslinking, or a resin having less than about 0.1 percent crosslinking. A crosslinked resin refers for example, to a crosslinked resin or gel comprising, for example, about 0.3 to about 20 percent crosslinking.

In embodiments, the resin selected can be a non-crosslinked resin such as, for example, a non-crosslinked resin comprising styrene:butylacrylate:beta-carboxyethyl acrylate, although not limited to these monomers, wherein, for example, the non-crosslinked resin monomers are present in an amount of from about 40 to about 95 percent styrene, from about 5 to about 60 percent butylacrylate, and about 0.05 parts per hundred to about 10 parts per hundred beta-carboxyethyl acrylate; or from about 60 to about 85 percent styrene, from about 15 to about 40 percent butylacrylate, and about 1 part per hundred to about 5 parts per hundred beta-carboxyethyl acrylate, by weight based upon the total weight of the monomers.

For example, the resin may be selected to contain a carboxylic acid group selected, for example, from the group consisting of acrylic acid, methacrylic acid, itaconic acid, beta carboxy ethyl acrylate (beta CEA), fumaric acid, maleic acid, and cinnamic acid, and wherein, for example, a carboxylic acid is selected in an amount of from about 0.1 to about 10 weight percent of the total weight of the resin.

In embodiments, a second latex can be a high glass transition temperature (high Tg) resin comprising from about 40 to about 95 percent styrene, from about 5 to about 60 percent butylacrylate, and from about 0.05 parts per hundred to about 10 parts per hundred beta-carboxyethyl acrylate; or from about 65 to about 90 percent styrene, from about 10 to about 35 percent butyl acrylate, and from about 1 part per hundred to about 5 parts per hundred beta-carboxyethyl acrylate by weight based upon the total weight of the monomers.

In further embodiments, the process provides a first resin (resin A) comprising a non-crosslinked resin having a first Tg of about 46° C. to about 56° C., about 48° C. to about 54° C., or about 51° C., and a second non-crosslinked resin (resin B) having a high Tg (high Tg being for example a glass transition temperature that is from about 5° C. to about 10° C. higher than the Tg of the first resin) of for example, at Tg of about 54° C. to about 65° C., about 56° C. to about 64° C., to about 59° C. In embodiments, a first resin including a styrene vinyl copolymer has a Tg of from about 48 to about 54° C. In embodiments, a second resin including a styrene vinyl copolymer has a TG of from about 56 to about 64° C. In embodiments, the second resin has a Tg of from about 5 to about 10° C. higher than the Tg of the first resin.

Illustrative examples of latex polymer or resin particles include known polymers selected from the group consisting of styrene acrylates, styrene methacrylates, butadienes, isoprene, acrylonitrile, acrylic acid, methacrylic acid, beta-carboxy ethyl acrylate, polyesters, poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methyl styrene-isoprene), poly(methyl methacrylate-isoprene), poly (ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly (styrene-butyl acrylate-methacrylic acid), poly(styrene-butyl acrylate-acrylonitrile), poly(styrene-butyl acrylate-acrylonitrile-acrylic acid), and styrene/butyl acrylate/carboxylic acid terpolymers, styrene/butyl acrylate/beta-carboxy ethyl acrylate terpolymers, PLIOTONE™ available from Goodyear, and mixtures thereof. The latex emulsion resin and the optional second latex resin selected can comprise the same resin or different resins.

The resin particles selected can be prepared by, for example, emulsion polymerization techniques, including semicontinuous emulsion polymerization methods, and the monomers used in such processes can be selected from, for example, styrene, acrylates, methacrylates, butadiene, isoprene, and optionally acid or basic olefinic monomers, such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride, and the like. The presence of acid or basic groups in the monomer or polymer resin is optional, and such groups can be present in various amounts of from about 0.1 to about 10 percent by weight of the polymer resin. Chain transfer agents, such as dodecanethiol or carbon tetrabromide, can also be selected when preparing resin particles by emulsion polymerization. Other processes of obtaining resin particles of from about 0.01 micron to about 1 micron can be selected from polymer microsuspension process, such as illustrated in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding process, or other known processes.

In embodiments, the toner processes disclosed herein comprise preparing a non-crosslinked latex resin (resin A) comprising, for example, styrene:butylacrylate:beta-carboxyethyl acrylate (beta CEA) (monomers A, B, and C), by emulsion polymerization, in the presence of an initiator, a chain transfer agent, and surfactant. The monomers are not limited to the particular range or type. The amount and composition of the resin monomers comprise, for example, from about 70 to about 90 percent styrene, from about 10 to about 30 percent butyl acrylate, and from about 0.5 to about 10 parts per hundred beta-carboxyethyl acrylate, or from about 76.5 percent styrene, 23.5 percent butyl acrylate, and 3 parts per hundred beta-carboxyethyl acrylate. The amounts of initiator, such as for example, sodium persulfate, potassium persulfate, or ammonium persulfate, can be selected in the range of from about 0.5 to about 5.0 percent by weight of the monomers. The amount of chain transfer agent used can be selected in the range of from about 0.5 to about 5.0 percent by weight of the monomers A and B. The surfactant can be an anionic surfactant, and can be selected in the range of from about 0.7 to about 5.0 percent by weight of the aqueous phase. For example, the monomers are polymerized under starve fed conditions as referred to in Xerox patents such as U.S. Pat. No. 6,447,974, U.S. Pat. No. 6,576,389, U.S. Pat. No. 6,617,092, and U.S. Pat. No. 6,664,017, which are hereby totally incorporated by reference herein, to provide latex resin particles having a diameter in the range of from about 100 to about 300 nanometers.

The molecular weight of the latex resin A can be, for example, about 30,000 to about 37,000, or from about 33,000 to about 34,000, although not limited. The onset glass transition temperature (Tg) of the resin A is from about 49° C. to about 60° C., or from about 48° C. to about 54° C., or about 51° C. The amount of carboxylic acid groups can be selected at from about 0.05 to about 5.0 parts per hundred of the resin monomers A and B. The molecular weight of the resin A obtained is about 34,000, and the molecular number is about 11,000, providing a non-crosslinked latex resin A having a pH of about 2.0. In embodiments, a first resin including a styrene vinyl copolymer has an Mw of from about 30,000 to about 37,000. In embodiments, the resin A has an Mw of from about 33,000 to about 34,000; an Mn of from about 5,000 to about 11,000, or about 8,500; an Mp of from about 20,000 to about 25,000, or about 23,000; and an MWD of about 3.5. As used herein, Mw is weight-average molecular weight.

A high Tg non-crosslinked latex resin (resin B) can be selected comprising styrene:butylacrylate:beta-carboxyethyl acrylate (beta CEA), again termed herein monomers A, B, and C, by an emulsion polymerization, in the presence of initiator, a chain transfer agent, and surfactant. In embodiments, the composition of the monomers A:B:C can be selected as comprising from about 70 to about 90 percent styrene, from about 10 to about 30 percent butylacrylate, and from about 0.05 parts per hundred to about 10 parts per hundred beta-carboxyethyl acrylate, or about 81.7% styrene, about 18.3% butyl acrylate, and about 3.0 parts per hundred beta-carboxyethyl acrylate. The amounts of initiator, such as sodium or ammonium persulfate, can be selected, for example, in the range of from about 0.5 to about 3.0 percent by weight of the monomers. The amount of chain transfer agent used can be selected, for example, in the range of from about 0.5 to about 3.0 percent by weight based upon the weight of the monomers A and B. The surfactant used can be an anionic surfactant, and can be selected in the range of from about 0.7 to about 5.0 percent by weight of the aqueous phase. The emulsion polymerization is conducted under a starve fed polymerization as referenced, for example, in the Xerox patents referred to above, to provide latex resin particles which are selected in the size range of from about 100 nanometers to about 300 nanometers volume average particle diameter.

The molecular weight of the latex resin B is from about 30,000 to about 40,000, or about 34,000, and the molecular number is about 11,000, providing a non-crosslinked latex resin B having a pH of about 2.0. The onset Tg of the high Tg resin B is from about 5° C. to about 10° C. higher than the Tg of resin A, or alternately, from about 55° C. to about 65° C., from about 56° C. to about 64° C., or about 59° C. In embodiments, a second resin including a styrene vinyl copolymer has a Mw of from 30,000 to about 40,000. The amount of carboxylic acid groups can be selected at from about 0.05 to about 5.0 parts per hundred of the resin monomers A and B.

Examples of anionic surfactants suitable for use in the resin latex dispersion can include, for example, sodium dodecylsulfate (SDS), sodium dodecylbenzene sulfonate, sodium dodecylnaphthalene sulfate, dialkyl benzenealkyl, sulfates and sulfonates, adipic acid, available from Aldrich, NEOGEN RK™, NEOGEN SC™ from Daiichi Kogyo Seiyaku or TAYCAPOWER BN2060 commercially available from Tayca Corporation or DOWFAX™ available from DuPont and the like. An effective concentration of the anionic surfactant generally employed can be, for example, from about 0.01 to about 10 percent by weight, and more specifically, from about 0.1 to about 5 percent by weight of monomers used to prepare the toner polymer resin.

Examples of nonionic surfactants that can be included in the resin latex dispersion include, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhodia as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. A suitable concentration of the nonionic surfactant can be, for example, from about 0.01 to about 10 percent by weight, or from about 0.1 to about 5 percent by weight of monomers used to prepare the toner polymer resin. The pigment dispersion can comprise pigment particles dispersed in an aqueous medium with a nonionic dispersantisurfactant. A dispersant having the same polarity as that of the resin latex dispersion can also be used.

Examples of additional surfactants, which may be added optionally to the aggregate suspension prior to or during the coalescence to, for example, prevent the aggregates from growing in size, or for stabilizing the aggregate size, with increasing temperature can be selected from anionic surfactants such as sodium dodecylbenzene sulfonate, sodium dodecylnaphthalene sulfate, dialkyl benzenealkyl, sulfates and sulfonates, adipic acid, available from Aldrich, NEOGEN R™, NEOGEN SC™ available from Daiichi Kogyo Seiyaku, and the like, among others.

Examples of the acids that can be used include, for example, nitric acid, sulfuric acid, hydrochloric acid, acetic acid, citric acid, trifluro acetic acid, succinic acid, salicylic acid and the like, and which acids are in embodiments utilized in a diluted form in the range of from about 0.5 to about 10 weight percent by weight of water, or in the range of from about 0.7 to about 5 weight percent by weight of water.

Introducing the sequestering or complexing component comprises in embodiments, introducing an organic complexing component selected from the group consisting of ethylenediaminetetraacetic acid, gluconal, sodium gluconate, potassium citrate, sodium citrate, nitrotriacetate salt, humic acid, and fulvic acid; salts of ethylenediaminetetraacetic acid, gluconal, sodium gluconate, potassium citrate, sodium citrate, nitrotriacetate salt, humic acid, and fulvic acid, alkali metal salts of ethylenediaminetetraacetic acid, gluconal, sodium gluconate, potassium citrate, sodium citrate, nitrotriacetate salt, humic acid, and fulvic acid; sodium salts of ethylenediaminetetraacetic acid, gluconal, sodium gluconate, tartaric acid, gluconic acid, oxalic acid, polyacrylates, sugar acrylates, citric acid, potassium citrate, sodium citrate, nitrotriacetate salt, humic acid, and fulvic acid; potassium salts of ethylenediaminetetraacetic acid, gluconal, sodium gluconate, potassium citrate, sodium citrate, nitrotriacetate salt, humic acid, and fulvic acid; and calcium salts of ethylenediaminetetraacetic acid, gluconal, sodium gluconate, potassium citrate, sodium citrate, nitrotriacetate salt, humic acid, fulvic acid, calcium disodium ethylenediaminetetraacetate dehydrate, diammoniumethylenediaminetetraacetic acid, pentasodium diethylenetriaminepentaacetic acid sodium salt, trisodium N-(hydroxyethyl)-ethylenediaminetriacetate, polyasparic acid, diethylenetriamine pentaacetate, 3-hydroxy-4-pyridinone, dopamine, eucalyptus, iminodisuccinic acid, ethylenediaminedisuccinate, polysaccharide, sodium ethylenedinitrilotetraacetate, nitrilo triacetic acid sodium salt, thiamine pyrophosphate, farnesyl pyrophosphate, 2-aminoethylpyrophosphate, hydroxyl ethylidene-1,1-diphosphonic acid, aminotrimethylenephosphonic acid, diethylene triaminepentamethylene phosphonic acid, ethylenediamine tetramethylene phosphonic acid, and mixtures thereof. For example, introducing the sequestering or complexing component in (vii) can comprise in embodiments introducing an organic complexing component comprising ethylenediaminetetraacetic acid, and the like.

Other examples of coagulants include cationic surfactant, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, C12, C15, C17 trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL B™ (benzalkonium chloride), available from Kao Chemicals, and the like, and mixtures thereof.

Inorganic complexing components can be selected from the group consisting of sodium silicate, potassium silicate, magnesium sulfate silicate, sodium hexameta phosphate, sodium polyphosphate, sodium tripolyphosphate, sodium trimeta phosphate, sodium pyrophosphate, bentonite, and talc, and the like. Organic and inorganic complexing components can be selected in an amount of about 0.01 weight percent to about 10.0 weight percent, or from about 0.4 weight percent to about 4.0 weight percent based upon the total weight of the toner.

Inorganic cationic coagulants include, for example, poly-aluminum chloride (PAC), poly-aluminum sufosilicate, aluminum sulfate, zinc sulfate, magnesium sulfate, chlorides of magnesium, calcium, zinc, beryllium, aluminum, sodium, other metal halides including monovalant and divalent halides. The coagulant can be present in an aqueous medium in an amount of from, for example, from about 0.05 to about 10 percent by weight, or from about 0.075 to about 5.0 percent by weight of total solids in the toner. The coagulant may also contain minor amounts of other components, for example nitric acid.

In embodiments, the coagulant may comprise a mixture of both an inorganic and an organic coagulant including, for example, PAC and SANIZOL B, aluminum sulfate and SANIZOL B, etc. Such mixtures of coagulants are also preferably used in an aqueous medium, each present in an amount of from, for example, from about 0.05 to about 5.0 percent by weight of total solids in the toner.

A colorant dispersion is selected, for example, comprising a cyan, magenta, yellow, or black pigment dispersion of each color in an anionic surfactant or optionally a non-ionic dispersion to provide, for example, pigment particles having a volume average particle diameter size selected of from about 50 nanometers to about 300 nanometers. The surfactant used to disperse each colorant, can be, for example, an anionic surfactant such as NEOGEN RK™. An Ultimaizer equipment can be used to provide the pigment dispersion, although media mill or other means can be utilized.

The toner can also comprise a colorant. Suitable colorants include pigments, dyes, mixtures of pigments and dyes, mixtures of pigments, mixtures of dyes, and the like. In embodiments, the colorant comprises carbon black, magnetite, black, cyan, magenta, yellow, red, green, blue, brown, mixtures thereof, selected for example, in an amount of from about 1 to about 25 percent by weight based upon the total weight of the composition.

Colorants can be selected in the form of a pigment dispersion comprising pigments particles having a size in the range of from about 50 to about 500 nanometers, water, and an anionic surfactant or polymeric stabilizer.

In some instances, pigments are available in the wet cake or concentrated form containing water, and can be easily dispersed utilizing a homogenizer, or simply by stirring, ball milling, attrition, or media milling. In other instances, pigments are available only in a dry form, whereby dispersion in water is effected by microfluidizing using, for example, a M-110 microfluidizer or an Ultimaizer and passing the pigment dispersion from about 1 to about 10 times through the chamber, or by sonication, such as using a Branson 700 sonicator, or a homogenizer, ball milling, attrition, or media milling with the optional addition of dispersing agents such as the aforementioned ionic or nonionic surfactants. In the instance of preparing carbon black pigment or other pigment dispersion, the above techniques can also be applied in the presence of a surfactant.

Specific colorants that may be used include, PALIOGEN™ Violet 5100 and 5890 (BASF), Normandy Magenta RD-2400 (Paul Ulrich), Permanent Violet VT2645 (Paul Ulrich), HELIOGEN™ Green L8730 (BASF), Argyle Green XP-111-S (Paul Ulrich), Brilliant Green Toner GR 0991 (Paul Ulrich), Lithol Scarlet D3700 (BASF), Toluidine Red (Aldrich), Scarlet for THERMOPLAST™ NSD Red (Aldrich), Lithol Rubine Toner (Paul Ulrich), Lithol Scarlet 4440, NBD 3700 (BASF), Bon Red C (Dominion Color), Royal Brilliant Red RD-8192 (Paul Ulrich), ORACET™ Pink RF (Ciba Geigy), PALIOGEN™ Red 3340 and 3871K (BASF), Lithol Fast Scarlet L4300 (BASF), HELIOGEN™ Blue D6840, D7080, K7090, K6910 and L7020 (BASF), SUDAN™ Blue OS (BASF), Neopen Blue FF4012 (BASF), PV FAST™ Blue B2G01 (American Hoechst), IRGALITE™ Blue BCA (Ciba Geigy), PALIOGEN™ Blue 6470 (BASF), Sudan II, III and IV (Matheson, Coleman, Bell), Sudan Orange (Aldrich), SUDAN™ Orange 220 (BASF), PALIOGEN™ Orange 3040 (BASF), Ortho Orange OR 2673 (Paul Ulrich), PALIOGEN™ Yellow 152 and 1560 (BASF), Lithol Fast Yellow 0991K (BASF), PALIOTOL™ Yellow 1840 (BASF), Novaperm Yellow FGL (Hoechst), Permanerit Yellow YE 0305 (Paul Ulrich), Lumogen Yellow D0790 (BASF), Suco-Gelb 1250 (BASF), Suco-Yellow D1355 (BASF), Suco Fast Yellow D1165, D1355 and D1351 (BASF), HOSTAPERM™ Pink E (Hoechst), FANAL™ Pink D4830 (BASF), CINQUASIA™ Magenta (DuPont), PALIOGEN™ Black L9984 (BASF), Pigment Black K801 (BASF) and particularly carbon blacks such as REGAL™330 (Cabot), Carbon Black 5250 and 5750 (Columbian Chemicals), and the like or mixtures thereof.

Additional useful colorants include pigments in water-based dispersions such as those commercially available from Sun Chemical, for example SUNSPERSE BHD 6011 (Blue 15 Type), SUNSPERSE BHD 9312 (Pigment Blue 15), SUNSPERSE BHD 6000 (Pigment Blue 15:3 74160), SUNSPERSE GHD 9600 and GHD 6004 (Pigment Green 7 74260), SUNSPERSE QHD 6040 (Pigment Red 122), SUNSPERSE RHD 9668 (Pigment Red 185), SUNSPERSE RHD 9365 and 9504 (Pigment Red 57, SUNSPERSE YHD 6005 (Pigment Yellow 83), FLEXIVERSE YFD 4249 (Pigment Yellow 17), SUNSPERSE YHD 6020 and 6045 (Pigment Yellow 74), SUNSPERSE YHD 600 and 9604 (Pigment Yellow 14), FLEXIVERSE LFD 4343 and LFD 9736 (Pigment Black 7) and the like or mixtures thereof. Other useful water-based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta EO2 which can be dispersed in water and/or surfactant prior to use.

Other useful colorants include, magnetites, such as Mobay magnetites MO8029, MO8960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Ulrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like or mixtures thereof. Illustrative examples of cyans include copper tetra(octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICO BLACK and cyan components may also be selected as pigments. The pigment dispersion comprises pigment particles dispersed in an aqueous medium with an anionic dispersant/surfactant or a nonionic dispersantisurfactant, and the wherein the dispersant/surfactant is in the range of from about 0.5 to about 10 percent.

The toner may also include known charge additives in effective amounts such as, from about 0.1 to about 5 weight percent, such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, and the like.

Surface additives that can be added to the toner compositions after washing or drying include, for example, metal salts, metal salts of fatty acids, colloidal silicas, metal oxides, mixtures thereof, and the like, which additives are usually present in an amount of from about 0.1 to about 2 weight percent, reference U.S. Pat. Nos. 3,590,000, 3,720,617, 3,655,374 and 3,983,045, the disclosures of which are totally incorporated herein by reference. Examples of suitable additives include zinc stearate and AEROSIL R9720 available from Degussa in amounts of from about 0.1 to about 2 percent which can be added during the aggregation process or blended into the formed toner product.

Toners can be prepared by known processes. In embodiments, composite toner particles can formed by mixing the noncrosslinked core latex resin A, in the presence of a wax and pigment dispersion to which a coagulant comprised of a poly metal halide such as polyaluminum chloride is added while being blended at high speeds using a polytron. The resulting mixture having a pH of from about 2.0 to about 3.0, is then aggregated by heating to a temperature below the resin Tg to provide a toner size aggregate. High Tg noncrosslinked latex resin B is then added to the formed aggregates. This later addition of high Tg latex (B) provides a shell over the preformed aggregates. The pH of the mixture is then changed by the addition of a sodium hydroxide solution to about 4.0, followed by the addition of VERSENE 100™ ethylenediaminetetra acetic acid (EDTA), which complexes with the metal ion of the poly metal halide and partially removes it from the toner. The resulting pH is from about 5.0 to about 6.0. At this pH, the carboxylic acid becomes ionized to provide additional negative charge on the aggregates thereby providing stability. The pH also prevents the particles from further growth or an increase in the GSD when heated above the Tg of the latex resin. The temperature is raised to about 95° C. to coalesce or fuse the aggregates to provide a composite particle upon further heating. Such fused particles are measured for shape factor or circularity using a SYSMEX™ FPIA 2100 analyzer until the desired shape is achieved, whereupon the pH is adjusted to 7.0, and the toner slurry is continually heated at about 95° C., until a total of 5 hours at 95° C. is achieved.

The mixture is allowed to cool to room temperature and washed using the following conditions. The first wash is conducted at a pH of about 10 at a temperature of 63° C., followed by a DIW water wash at room temperature. This is followed by a wash at a pH of 4.0 at a temperature of 40° C. followed by a final DIW water wash. The toner is then dried.

Also provided herein are developer and imaging processes, including a process for preparing a developer comprising preparing a toner composition with the toner processes illustrated herein and mixing the resulting toner composition with a carrier. Developer compositions can be prepared by mixing the toners obtained with the processes of the present disclosure with known carrier particles, including coated carriers, such as steel, ferrites, and the like, reference U.S. Pat. Nos. 4,937,166 and 4,935,326, the disclosures of which are totally incorporated herein by reference, using, for example from about 2 to about 8 percent toner concentration. The carriers selected may also contain dispersed in the polymer coating a conductive compound, such as a conductive carbon black and which conductive compound is present in various suitable amounts, such as from about 15 to about 65, or from about 20 to about 45 weight percent by weight of total solids.

Imaging methods are also envisioned as part of the present disclosure, reference for example a number of the patents mentioned herein, and U.S. Pat. No. 4,265,660, the disclosure of which is totally incorporated by reference herein. Imaging processes comprise, for example, preparing an image with an electrophotographic or xerographic device comprising a charging component, an imaging component, a photoconductive component, a developing component, a transfer component, and a fusing component; and wherein the development component comprises a developer prepared by mixing a carrier with a toner composition prepared with the toner processes illustrated herein; an imaging process comprising preparing an image with an electrophotographic or xerographic device comprising a charging component, an imaging component, a photoconductive component, a developing component, a transfer component, and a fusing component; wherein the development component comprises a developer prepared by mixing a carrier with a toner composition prepared with the toner processes illustrated herein; and wherein the electrophotographic or xerographic device comprises a high speed printer, a black and white high speed printer, a color printer, or combinations thereof.

The size of the toner particles can be, for example, from about 1 to about 25 microns, from about 3 microns to about 9 microns, more specifically, from about 4 microns to about 6 microns or about 5 microns.

The following Examples are being submitted to further define various species of the present disclosure. These Examples are intended to be illustrative only and are not intended to limit the scope of the present disclosure. Also, parts and percentages are by weight unless otherwise indicated.

EXAMPLES

Example 1

Preparation of Latex Resin A (Low Tg)

A latex emulsion designated as resin A comprising polymer particles generated from the emulsion polymerization of styrene, n-buty acrylate and beta-CEA was prepared as follows.

A surfactant solution comprising 605 grams Dowfax 2A1 (anionic emulsifier) and 387 kg deionized water was prepared by mixing for 10 minutes in a stainless steel holding tank. The holding tank was then purged with nitrogen for 5 minutes before transferring it into a reactor. The reactor was then continuously purged with nitrogen while being stirred at 100

RPM. The reactor was then heated up to 80° C. and held there. Separately, 6.1 kg of ammonium persulfate initiator was dissolved in 30.2 kg of deionized water.

Separately, the monomer emulsion was prepared in the following manner.

An amount of 311.4 kg of styrene, 95.6 kg of butyl acrylate, 12.21 kg of beta-CEA, 2.88 kg of 1-dodecanethiol, 1.42 kg of ADOD, 8.04 kg of DOWFAX 2A1 (anionic surfactant), and 193 kg of deionized water, were all mixed to form an emulsion. An amount of 1 percent of the above emulsion was then slowly fed into a reactor containing the aqueous surfactant phase at 80° C. to form the "seeds" while being purged with nitrogen. The initiator solution was then slowly charged into the reactor, and after 10 minutes, the rest of the emulsion was continuously fed in using a metering pump at a rate of 0.5 percent/minute. Once all the monomer emulsion was charged into the main reactor, the temperature was held at 80° C. for an additional 2 hours to complete the reaction. Full cooling was then applied and the reactor temperature was reduced to 35° C. The product was collected into a holding tank. After drying, the latex molecular properties were Mw=35,419; Mn=11,354, and the onset Tg was 51° C.

Example 2

Preparation of Latex Resin B (High Tg)

A latex emulsion designated as resin B comprising polymer particles generated from the emulsion polymerization of styrene, n-butyl acrylate and beta-CEA was prepared as follows.

A surfactant solution comprising 605 grams DOWFAX 2A1 (anionic emulsifier) and 387 kg deionized water was prepared by mixing for 10 minutes in a stainless steel holding tank. The holding tank was then purged with nitrogen for 5 minutes before transferring into the reactor. The reactor was then continuously purged with nitrogen while being stirred at 100 RPM. The reactor was then heated up to 80° C., and held there. Separately, 6.1 kg of ammonium persulfate initiator was dissolved in 30.2 kg of deionized water.

Separately, the monomer emulsion was prepared in the following manner.

An amount of about 332.5 kg of styrene, 74.5 kg of butyl acrylate, 12.21 kg of beta-CEA, 2.88 kg of 1-dodecanethiol, 1.42 kg of ADOD, 8.04 kg of DOWFAX 2A1 (anionic surfactant), and 193 kg of deionized water, were all mixed to form an emulsion. An amount of 1 percent of the above emulsion was then slowly fed into a reactor containing the aqueous surfactant phase at 80° C. to form the "seeds" while being purged with nitrogen. The initiator solution was then slowly charged into the reactor, and after 10 minutes, the rest of the emulsion was continuously fed using a metering pump at a rate of 0.5 percent/minute. Once all the monomer emulsion was charged into the main reactor, the temperature was held at 80° C. for an additional 2 hours to complete the reaction. Full cooling was then applied and the reactor temperature was reduced to 35° C. The product was collected into a holding tank. After drying, the latex molecular properties were Mw=33,700; Mn=10,900, and the onset Tg was 58.6° C.

Example 3

Preparation of Toner

An emulsion aggregation toner was prepared as follows.

An amount of 576.7 grams of DIW with 277.0 grams of latex A (41% solids), 107.13 grams of X1214#1 (20% solids) wax (from Baker Petrolite) and 64.1 grams of PB:15:3 cyan pigment (17% solids) were all charged into a 2-liter plastic container. The mixture was homogenized using an IKA TURRAX™ probe at 6,000 rpm for 10 minutes. A 10 percent polyaluminum chloride PAC solution comprising diluted nitric acid, was added to the plastic container during the homogenization period. The PAC solution comprised 3.6 grams of polyaluminum chloride plus 32.4 grams of 0.02 molar diluted nitric acid. The resulting slurry was transferred to a 2-liter size stainless steel BUCHI™ reactor. The reactor was installed with a mechanical agitator and equipped with a double pitched blade impellors. The mixture was agitated at 800 rpm in the reactor. The reactor content was heated to 52° C., and the particle size was monitored. When the particle size of 5.2 microns was reached, an additional 134.6 grams of higher Tg latex B (41% solids) was added as shell latex. The reactor temperature was maintained at 52° C., for an additional 60 minutes, and a particle size of 5.5 microns was obtained. An amount of 4.8 grams of VERSENE™ 100 (39% active tetrasodium ethylene diamine tetraacetate in sodium hydroxide solution and available from Dow Chemicals) was added to the reactor content. By this addition, the pH of the reactor content increased from 2.6 to about 4.0. After about 10 minutes, additional sodium hydroxide was added to increase the pH to 5.4. The reactor temperature was then raised from 52° C. to 95° C. in 45 minutes and maintained at 95° C. for 3 hours for coalescence, before cooling. The circularity of the particle was determined to be 0.966. The particle size was measured on a COULTER COUNTER™ and found to be 5.5 microns with a GSD of 1.18. The toner was washed by adjusting the pH of the slurry to 8.8, and heated to a temperature of 63° C. for 20 minutes.

The resulting toner slurry was filtered and washed with water once followed by a diluted nitric acid and a final DIW wash. The final 5.5 micron cyan EA toner was dewatered and dried for toner evaluation and characterization processes.

The above procedure was repeated, but by using a different batch of fractionated wax each time. The different fractionated waxes used were X1214#3, X1214#4, and X1214#2, each from Baker Petrolite. The toners were then evaluated for toner properties such as gloss, crease, hot offset, blocking, release, and other properties. The toners produced good results in each area.

It will be appreciated that various of the above-discussed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A chemical toner composition comprising a) a first resin comprising a styrene vinyl copolymer and having a Tg of from about 46 to 56° C., b) a second resin comprising a styrene vinyl copolymer having a Tg of from 54 to about 65° C., c) a distilled crystalline polyethylene wax having a heat of crystallization and a heat of enthalpy, both from about 1.0 to about 4.0 J/g for every weight percent of the wax used in the chemical toner composition, and wherein said wax has a peak melting point of from about 70 to 99° C., and d) a colorant, wherein said chemical toner has a gloss of from about 30 to about 80 GGU and wherein said second resin has a Tg of from about 5 to about 10° C. higher than the Tg of the first resin.

2. The toner of claim 1, wherein said peak melting point is from about 80 to about 95° C.

3. The toner of claim 2, wherein said peak melting point is from about 85 to about 94° C.

4. The toner of claim 1, wherein said gloss is from about 40 to about 70 GGU.

5. The toner of claim 1, wherein said heat of crystallization and said heat of enthalpy is from about 1.5 to about 3.0 J/g.

6. The toner of claim 1, wherein said toner has a blocking temperature as measured by the heat cohesion of from about 45 to about 65° C.

7. The toner of claim 6, wherein said blocking temperature is from about 53 to about 65° C.

8. The toner of claim 1, wherein said toner has a circularity of from about 0.95 to about 1.00.

9. The toner of claim 1, wherein said toner has a toner cohesion of from about 5 to about 65, wherein toner cohesion is calculated as percent cohesion using the following expression $$\%\ \text{toner cohesion}=[(M_A/M_T)+\tfrac{3}{5}(M_B/M_T)+\tfrac{1}{5}(M_C/M_T)]\times 100$$

wherein $M_A$ is the toner mass collected on a 53 micron pore size screen, $M_B$ is the toner mass collected on a 45 micron pore size screen, $M_C$ is the toner mass collected on a 38 micron pore size screen, and $M_T$ is the mass of the toner quantity used.

10. The toner of claim 1, wherein said toner has a melt flow index of from about 25 to about 50, when measured at a temperature of 125° C. and a load of 5 kg.

11. The toner in accordance with claim 1, wherein said toner has a crease (80) minimum fixing temperature of from about 140 to about 160° C.

12. The toner of claim 1, wherein said first and second resin both comprise a styrene acrylate resin.

13. The toner of claim 1, wherein said first and second resins both comprise a styrene n-butyl acrylate resin.

14. The toner claim 1, wherein said first resin comprises styrene, butyl acrylate, and beta carboxy ethyl acrylate.

15. The toner of claim 1, wherein said second resin comprises styrene, butyl acrylate, and beta carboxy ethyl acrylate.

16. The toner of claim 1, wherein said first resin has a Tg of from about 48 to about 54° C.

17. The toner of claim 1, wherein said second resin has a Tg of from about 56 to about 64° C.

18. The toner of claim 1, wherein said first resin has an Mw of from about 30,000 to about 37,000.

19. The toner of claim 1, wherein said second resin has an Mw of from about 30,000 to about 40,000.

20. The toner in accordance with claim 1, wherein said toner further comprises a coagulant.

21. The toner in accordance with claim 20, wherein said coagulant is selected from the group consisting of polyaluminum chloride and polyaluminum sulfosilicate.

22. The toner in accordance with claim 20, wherein said coagulant comprises a metal ion, and wherein said metal ion of said coagulant is present in said toner composition in an amount of from about 250 to about 500 ppm.

23. A chemical toner composition comprising a) a first resin comprising a styrene vinyl copolymer and having a Tg of from about 48 to 54° C., and an Mw of from about 30,000 to about 37,000, b) a second resin comprising a styrene n-butyl acrylate having a Tg of from 56 to about 64° C., c) a distilled crystalline polyethylene wax having a heat of crystallization and a heat of enthalpy, both from about 1.0 to about 4.0 J/g for every weight percent of the wax used in the chemical toner composition, and wherein said wax has a peak melting point of from about 70 to 99° C., and d) a colorant, wherein said chemical toner has a gloss of from about 30 to about 80 GGU.

24. A chemical toner composition comprising a) a first resin comprising styrene, butyl acrylate and beta carboxy ethyl acrylate, and having a Tg of from about 46 to 56° C., b) a second resin comprising a styrene vinyl copolymer having a Tg of from 54 to about 65° C., c) a distilled crystalline polyethylene wax having a heat of crystallization and a heat of enthalpy, both from about 1.0 to about 4.0 J/g for every weight percent of the wax used in the chemical toner composition, and wherein said wax has a peak melting point of from about 70 to 99° C., and d) a colorant, wherein said chemical toner has a gloss of from about 30 to about 80 GGU.

* * * * *